United States Patent [19]

Hartley

[11] 4,153,391

[45] May 8, 1979

[54] TRIPLE DISCHARGE PUMP

[75] Inventor: Ezra D. Hartley, Los Angeles, Calif.

[73] Assignee: Carr-Griff, Inc., Anaheim, Calif.

[21] Appl. No.: 829,222

[22] Filed: Aug. 31, 1977

Related U.S. Application Data

[63] Continuation of Ser. No. 581,711, May 29, 1975, abandoned.

[51] Int. Cl.[2] ..... F04B 1/12; F04B 1/18

[52] U.S. Cl. ..... 417/269; 417/271; 417/566

[58] Field of Search ..... 417/269, 271, 566

[56] References Cited

U.S. PATENT DOCUMENTS

| | | | |
|---|---|---|---|
| 1,819,966 | 8/1931 | Olson | 417/269 |
| 2,797,647 | 7/1957 | Floraday | 417/566 |
| 2,969,745 | 1/1961 | Johnson | 417/566 |
| 2,991,723 | 7/1961 | Zubaty | 417/269 |
| 3,199,531 | 8/1965 | Cornelius et al. | 417/271 |
| 3,552,886 | 1/1971 | Olson, Jr. | 417/269 |
| 3,712,759 | 1/1973 | Olson, Jr. | 417/269 |
| 3,754,842 | 8/1973 | Schlanzky | 417/269 |

FOREIGN PATENT DOCUMENTS

| | | | |
|---|---|---|---|
| 1157249 | 5/1958 | France | 417/269 |
| 644086 | 8/1962 | Italy | 417/269 |

*Primary Examiner*—William L. Freeh
*Attorney, Agent, or Firm*—Gordon L. Peterson

[57] ABSTRACT

A pump comprising a supporting structure including a bearing support, a wobble plate, a bearing between the bearing support and the wobble plate for permitting the wobble plate to nutate and for transmitting radial loads from the wobble plate to the bearing support, a cam rotatably mounted on the supporting structure for causing the wobble plate to nutate, and a mechanism for drivingly coupling the cam to a shaft of a motor. Radial loads are transmitted by the bearing to the supporting structure rather than to the cam. The wobble plate is coupled to a suitable output device such as the diaphragm of a diaphragm pump.

17 Claims, 9 Drawing Figures

TRIPLE DISCHARGE PUMP

This is a continuation of application Ser. No. 581,711 filed May 29, 1975 now abandoned.

BACKGROUND OF THE INVENTION

In many instances a pump imposes radial loads on the output shaft of the motor which is used to drive the pump. For example, a wobble plate type of pump typically introduces radial loads to the output shaft of the motor. To enable the motor to withstand these radial loads, it is common practice to use ball bearings to support the output shaft of the motor. Although ball bearings work satisfactorily, they are relatively expensive. In addition, the radial loads cause the bearings to wear more rapidly than if no radial loads were imposed on the output shaft.

SUMMARY OF THE INVENTION

The present invention provides a wobble plate type of pump which imposes substantially no radial load on the output shaft of the motor which drives it. Accordingly, the output shaft of the motor can be supported by inexpensive sleeve bearings and bearing wear is minimized. This concept of the invention is applicable to wobble plate drive mechanisms used in connection with a pump or with other output devices. As used herein, the word "pump" is intended to include pumps and compressors for all fluids including liquids and gases.

Because of the nutating motion of the wobble plate, radial loads are inherently created. However, with this invention, the radial loads are taken up by the supporting structure of the pump and not by the output shaft of the motor.

This can advantageously be accomplished by providing a supporting structure including a bearing support and bearing means between the bearing support and the wobble plate for permitting the wobble plate to nutate and for transmitting radial loads from the wobble plate to the bearing support. For example, the bearing support and the bearing means may have mating spherical surfaces which are relatively slidable. In a preferred form of the invention, the spherical surface of the bearing support defines a cavity and the bearing means includes a ball receivable in the cavity and engageable with mating spherical surfaces on the wobble plate. Radial loads are transmitted from the wobble plate through the ball to the bearing support. This constitutes a simple and inexpensive mounting structure for the wobble plate and eliminates the need for relatively expensive ball bearings for mounting the output shaft of the motor.

The wobble plate is driven by suitable means such as a cam rotatably mounted on the supporting structure, and the cam in turn is driven by the output shaft of the motor. The present invention also assures that substantially no radial loads will be transmitted from the wobble plate to the cam. This can be advantageously accomplished by utilizing a bearing, such as a needle bearing, between the cam and the wobble plate which is incapable of transmitting radial loads. Bearings of this type are inexpensive and transmit only axial loads to the cam. Another bearing, such as a needle bearing, which is capable of transmitting only axial loads is interposed between the cam and the supporting structure. Thus, only axial loads are transmitted through the cam, and the axial loads are also resisted by the supporting structure and not by the output shaft of the motor.

To compensate for misalignment and to reduce noise, the output shaft is preferably coupled to the cam by means of a flexible coupling. The coupling also allows for some relative axial movement between the cam and the output shaft so that no axial load can be transmitted to the output shaft.

Although the wobble plate construction could be used to drive various output devices, it is particularly adapted for use with a diaphragm pump. Another feature of this invention is that a single diaphragm can be used as the diaphragm for multiple pumping chambers. For example, first, second, and third regions of the diaphragm may be used as the diaphragms for first, second, and third pumping chambers, respectively. Thus, a single diaphragm can be used to replace multiple diaphragms.

The diaphragm serves other important functions. For example, the supporting structure of the pump includes a housing having a cavity and the diaphragm extends across the cavity to divide the cavity into a pumping compartment on one side of the diaphragm and an equipment compartment on the other side of the diaphragm. The wobble plate and other portions of the drive mechanism are located in the equipment compartment, and the pumping chambers are located in the pumping compartment. Thus, the diaphragm isolates the mechanical parts of the pump from the parts of the pump which contact the fluid to be pumped. This in turn assures that no lubricant utilized for the mechanical parts of the pump will get into the fluid being pumped. Conversely, the fluid being pumped cannot contact and corrode the mechanical pump parts.

Another function of the diaphragm is that it can be used to form a seal between the pumping compartment and the equipment compartment. For example, the housing may include first and second housing sections and the diaphragm can be clamped between the housing sections to form a seal between the housing sections.

Because of the nutating motion of the wobble plate, one of the pumping chambers may be on its intake stroke while another of the pumping chambers may be on its discharge stroke. It is necessary, therefore, to seal the pumping chambers from each other. Although this could be accomplished in different ways, it can be simply and inexpensively accomplished by utilizing integral portions of the diaphragm to form seals between the pumping chambers.

Each of the regions of the diaphragm which forms a portion of an associated pumping chamber is connected to a region of the wobble plate. Each of such regions of the diaphragm should reciprocate generally axially to provide the desired pumping action. However, the nutating motion of the wobble plate is a form of compound motion which tends to move the diaphragm regions axially and radially. Accordingly, there is a need for a lost motion connection between the wobble plate and each of the diaphragm regions. Although this could be accomplished in different ways, the diaphragm can be formed with appropriate folds which will accommodate the compound motion of the wobble plate while permitting reciprocation of the diaphragm regions. Thus, the single diaphragm of the pump of this invention performs numerous functions, and it eliminates a substantial number of additional parts and facilitates assembly.

Each of the pumping chambers has an inlet and an outlet. A common inlet chamber is provided in the housing in communication with each of the inlets of the pumping chambers. Similarly, a common outlet chamber is provided in the housing in communication with the outlets of each of the pumping chambers.

The invention can best be understood by reference to the following description taken in connection with the accompanying illustrative drawing.

DESCRIPTION OF THE PREFERRED EMBODIMENTS

Figure 1:
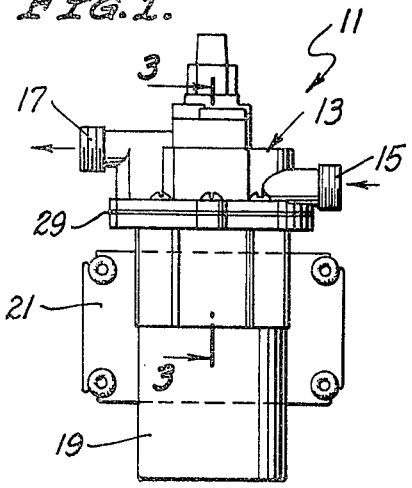
FIG. 1 is a front elevational view of a pump constructed in accordance with the teachings of this invention.
Figure 2:
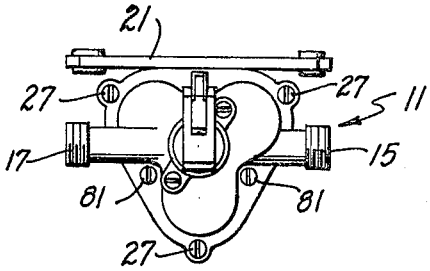
FIG. 2 is a top plan view of the pump.

FIGS. 1 and 2 show a pump 11 constructed in accordance with the teachings of this invention. The pump 11 includes a housing 13 having an inlet 15 and an outlet 17. A motor 19 is attached to the housing 13 as described hereinbelow, and the pump 11 and the motor can be appropriately mounted to external structure by a mounting plate 21.

Figure 3:
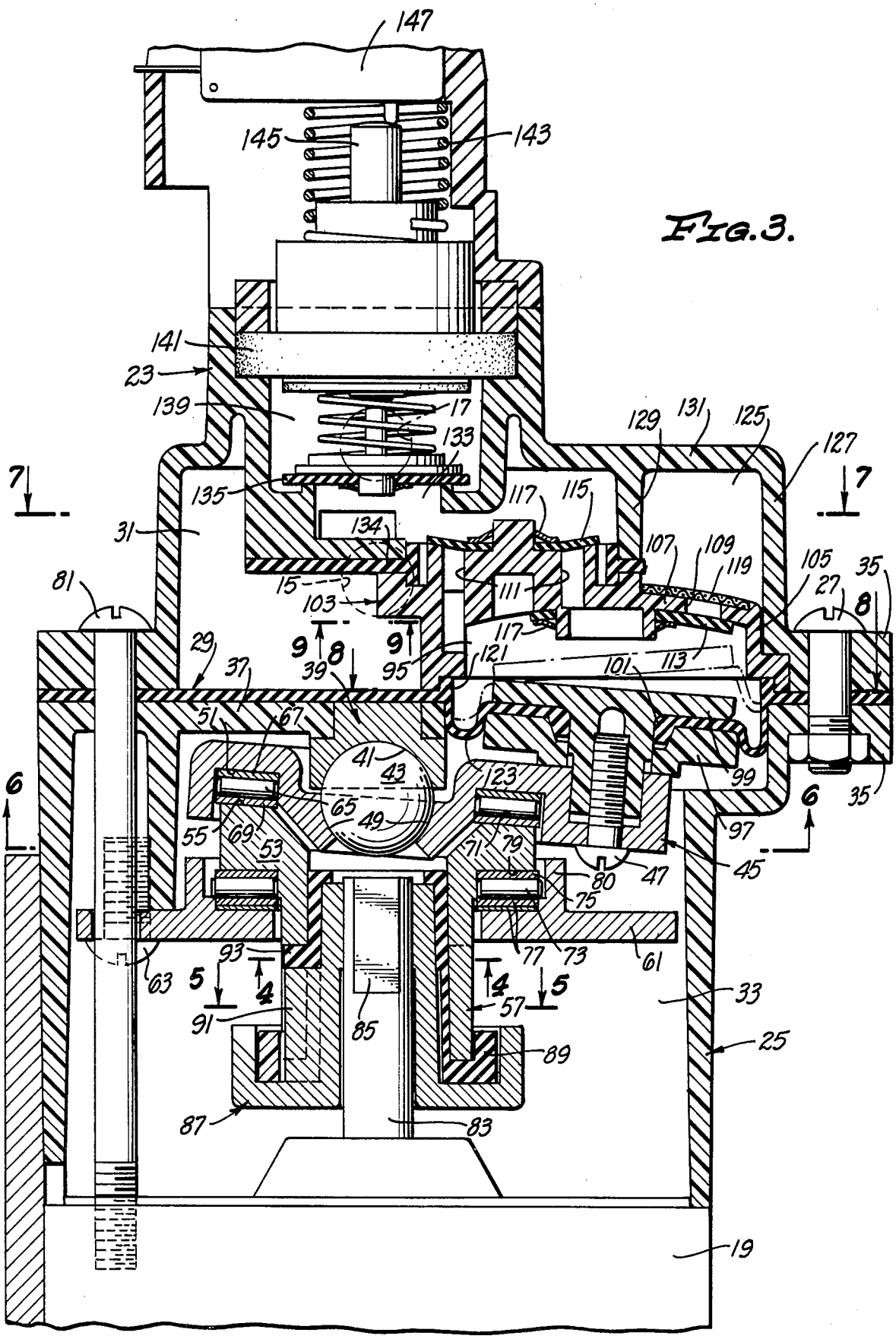
FIG. 3 is an enlarged fragmentary sectional view taken generally along line 3—3 of FIG. 1.

With reference to FIG. 3, the housing 13, which forms a portion of the supporting structure for the pump 11, includes housing sections 23 and 25 which are suitably releasably interconnected as by a plurality of screws 27 (FIGS. 2 and 3). The housing sections 23 and 25 can advantageously be constructed of molded plastic material. An integral flexible resilient diaphragm 29 extends radially across the interior cavity of the housing 13 and is clamped between the housing sections 23 and 25 to divide the cavity into a pumping compartment 31 and an equipment compartment 33. A peripheral region of the diaphragm 29 is clamped between clamping sections or confronting flanges 35 so that the diaphragm completely seals the compartment 31 from the compartment 33.

The housing section 23 has an integral spider 37 on which a socket 39 of bronze or other material is suitably mounted. The socket 39 has a spherical cavity 41 in which a ball 43 of steel or other hard material is received. The radius of the ball 43 is substantially equal to the radius of the spherical surface of the cavity 41. The ball 43 forms a bearing and the spider 37 and the socket 39 form a bearing support.

Figure 6:
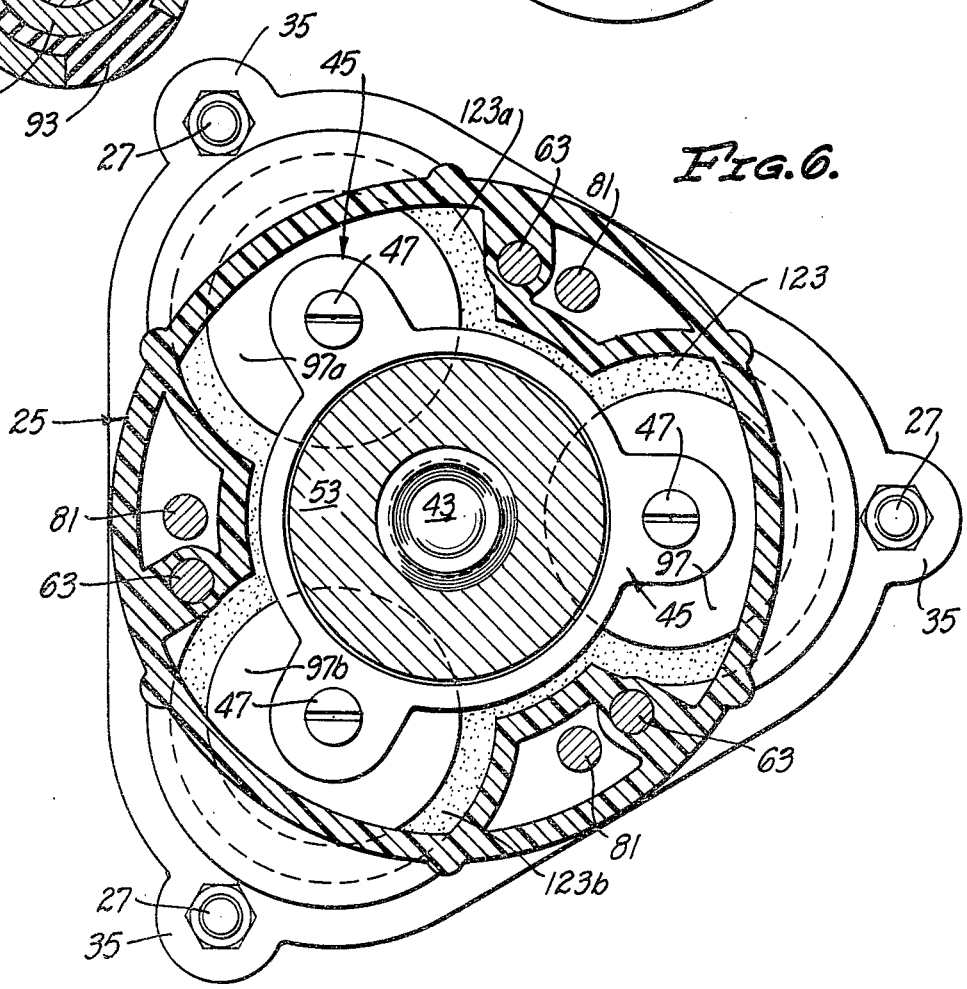
FIG. 6 is a sectional view taken generally along line 6—6 of FIG. 3.

A wobble plate 45 is attached to the diaphragm 29 at a plurality of circumferentially spaced locations by screws 47 as more particularly described hereinbelow (FIGS. 3 and 6). The wobble plate has a centrally located concave spherical surface 49 which seats on the ball 43. The wobble plate 45 may be constructed of metal, and its axis extends diametrically through the ball 43. The wobble plate 45 defines an annular recess 51 which opens downwardly as viewed in FIG. 3.

Figure 4:
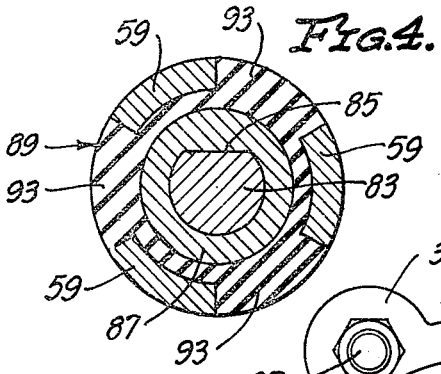
FIG. 4 is a sectional view taken generally along line 4—4 of FIG. 3.

Means are provided for causing the wobble plate 45 to wobble, or more specifically to nutate. In the embodiment illustrated, such means includes a cam 53. The cam 53 includes an inclined, annular, planar surface 55 and a tube portion 57, the outer end of which is slotted axially to form a plurality of axially extending fingers 59 (three being shown in FIG. 4). The tube portion 57 projects through an opening formed in a plate 61 which is removably attached to the housing section 25 by a plurality of screws 63 (FIGS. 3 and 6). The plate 61 forms a portion of the supporting structure for the pump 11.

Means are provided between the cam 53 and the wobble plate 45 to prevent radial loads from being transmitted to the cam. Although this could be accomplished in different ways such as by antifriction bearings, balls, rollers, and low friction surfaces, in the embodiment illustrated, such means includes a needle bearing 65 retained in the recess 55 between annular plates or washers 67 and 69. The needle bearing 65 is capable of transmitting axial loads, but is incapable of transmitting radial loads. The washers 67 and 69 may be appropriately retained on the wobble plate 45 and the inclined surface 55, respectively, in which event the washer 69 forms a portion of the cam 53 and its outer surface defines a flat, planar, inclined, annular cam surface 71.

The axial thust against the cam 53 is suitably transmitted to the plate 61. In the embodiment illustrated, a needle bearing 73 and washers 75 and 77 are interposed between a shoulder 79 of the cam and the plate. The bearing 73 and the washers 75 and 77 are radially restrained by the tube 57 and an axial flange 80 formed integrally on the plate 61. The washers 75 and 77 and the needle bearing 73 transmit the axial thrust to the plate 61. The needle bearings 65 and 73 also serve to mount the cam 53 for rotation about a rotational axis which is substantially coincident with the axis of the wobble plate 45 and with a diametric axis of the ball 43.

The motor 19 is suitably mounted on the housing section 25 as by a plurality of screws 81 (FIGS. 3 and 6). The motor 19 has an output shaft 83 which is rotatable to drive the cam 53. In the embodiment illustrated, the output shaft 83 is coupled to the cam 53 by a flexible coupling.

Figure 5:
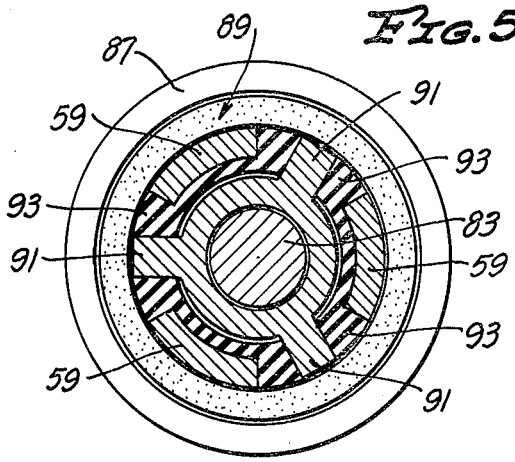
FIG. 5 is a sectional view taken generally along line 5—5 of FIG. 3.

Specifically, the output shaft 53 has a flat 85 (FIGS. 3 and 4) which is received within a tubular coupling section 87 which has a mating flat to thereby permit the output shaft 83 to drive the coupling section 87. The coupling section 87 is in turn slidably receivable in a flexible resilient bushing 89. The bushing 89 is constructed of any suitable resilient material such as rubber. To provide a driving connection between the coupling section 87 and the bushing 89, the coupling section has a plurality of circumferentially spaced, axially extending teeth 91 (FIGS. 3 and 5) which are received within open ended slots formed in circumferentially spaced lugs 93 of the bushing. The lugs 93 are received in the slots between the fingers 59 to define a driving connection between the bushing 89 and the cam 53. The resilient bushing 89 reduces noise and accommodates some misalignment between the output shaft 83 and the cam 53.

In operation of the wobble plate mechanism described hereinabove, the output shaft 83 of the motor 19 rotates the cam 53 through the coupling section 87 and the bushing 89. Rotation of the cam 53 causes the inclined cam surface 71 to impart a nutating motion to the wobble plate 45. The ball 43 is not affixed to the socket 39 or to the spherical surfaces 49. Accordingly, relative sliding movement can occur between the ball 43 and the socket 39 and the spherical surfaces 49. The degree to which relative sliding motion occurs at these two interfaces is a function of the relative coefficients of friction at the interfaces.

As the cam 53 rotates, it applies an axial force in the upward direction (as viewed in FIG. 3) to one region of the wobble plate 45. This tends to pivot the wobble plate 45 about the axis of the ball 43. Any radial loads are transmitted by the ball 43 to the socket 39 and the spider 37 to the housing section 25. The cam 53 is not loaded radially because the needle bearings 65 are incapable of transmitting radial loads to the cam. As the cam 53 is not loaded radially, the cam does not impart any radial load to the output shaft 83. Furthermore, axial loads on the cam 53 are transmitted through the needle bearing 73 to the plate 61, and so no axial load is imparted to the shaft 83. Thus, the wobble plate mechanism imparts neither axial nor radial loads to the output shaft 83. For this reason, the output shaft 83 may be supported by inexpensive sleeve bearings, and this significantly reduces the cost of the motor.

The wobble plate construction described hereinabove can be utilized to drive many different devices. However, it is particularly adapted to form a portion of a diaphragm pump.

Figure 8:
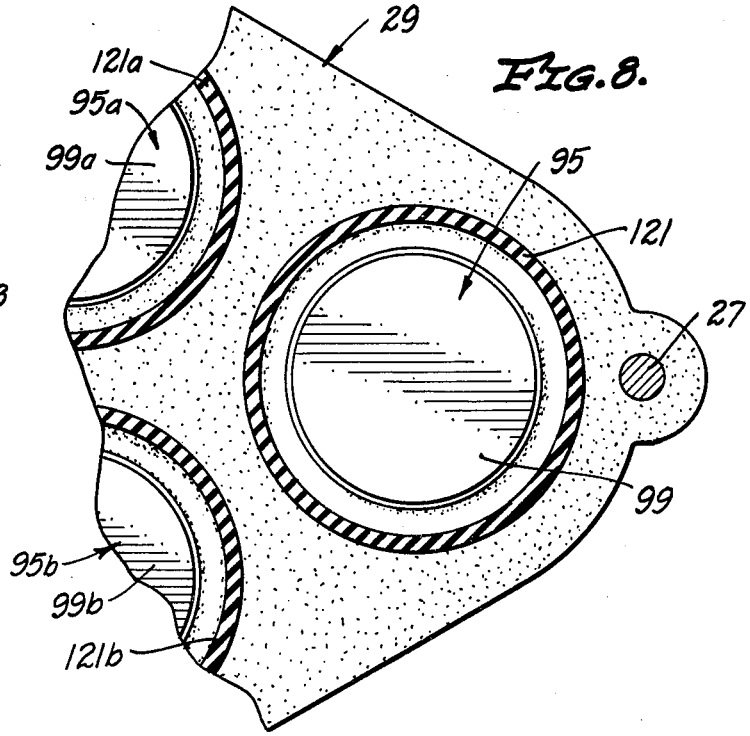
FIG. 8 is a fragmentary sectional view partially in section taken generally along line 8—8 of FIG. 3.

The diaphragm 29 is constructed of flexible resilient material such as rubber and it may have fabric molded into it for added strength. The diaphragm 29 cooperates with other structure of the pump 11 to define a plurality of pumping chambers. As shown in FIG. 3, a first region of the diaphragm 29 cooperates with other structure of the pump 11 to define a pumping chamber 95. Other regions of the diaphragm 29 cooperate with corresponding structure of the pump 11 to define pumping chambers **95*a* and 95*b* (FIG. 8). The pumping chambers 95*a* and 95*b* are identical to the pumping chamber 95, and portions of these latter two pumping chambers corresponding to portions of the pumping chamber 95** are designated by corresponding reference numerals followed by the letters a and b, respectively.

As shown in FIG. 3, a region of the diaphragm 29 is clamped between plate-like clamps 97 and 99. The clamp 99 is mounted on the wobble plate 45 by the screw 47, and the screw 47 can be tightened to tighten the clamps. The clamps 99 extend through an opening in the diaphragm 29, and an annular ridge 101 on the diaphragm surrounds the opening to form a fluid tight seal between the diaphragm and the clamps 97 and 99. To further assure a fluid tight seal, the ridge 101 is received with an annular recess defined by the clamps 97 and 99. Other regions of the diaphragm 29 are similarly attached to the wobble plate at the pumping chambers **99*a* and 99*b***.

It should be understood that the diaphragm 29 can be utilized to partially define any suitable number of pumping chambers, and the three pumping chambers 95, **95*a* and 95*b* shown herein are merely illustrative. However, by using at least three pumping chambers, a more even discharge from the pump 11** is obtained.

Cooperating with a region of the diaphragm 29 to define the pumping chamber 95 is a cup-shaped insert 103 (FIG. 3) which may be constructed, for example, of molded plastic material. The insert 103 has a peripheral wall 105 which surrounds the pumping chamber 95 and an end wall 107 opposite the diaphragm 29. Openings are formed in the end wall 107 to define an inlet 109 and an outlet 111 for the pumping chamber 95. An inlet check valve 113 and an outlet check valve 115 are carried by the insert 103. Each of the valves 113 and 115, in the embodiment illustrated, is in the form of a resilient, flexible washer retained on the insert by a spring clip 117. A filter 119 in the form of a screen is carried by the insert 103 with the filter extending across the inlet 109. An integral annular seal 121 is formed on the diaphragm 29 to seal the interface between the diaphragm and the peripheral wall 105 of the insert 103. In other words, the seal 121 seals the pumping chamber 95 from the pumping chambers **95*a* and 95*b***.

The diaphragm 29 is also provided with a fold 123 of U-shaped cross section which circumscribes the clamp 99 and which opens inwardly toward the pumping chamber 95. The fold 123 allows the region of the diaphragm associated with the pumping chamber 95 to move axially to provide a pumping action. In addition, the fold 123 allows some radial displacement of such region of the diaphragm. This is necessary to accommodate the nutating motion of the wobble plate 45.

Figure 9:
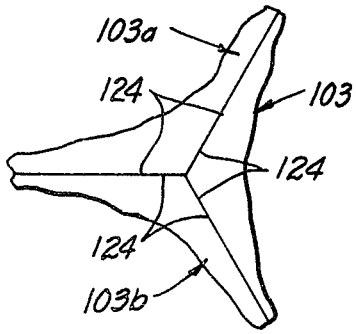
FIG. 9 is a fragmentary view taken generally on line 9—9 of FIG. 3 and showing the inner regions of the inserts used to partially define the pumping chambers.

The pumping chambers **95*a* and 95*b* are formed identically by corresponding inserts 103*a* and 103*b*. The inserts 103, 103*a* and 103*b* are held in position by the housing section 23, the diaphragm 29, and to a certain degree by engagement with each other along their inner surfaces 124** as shown in FIG. 9.

The housing section 23 defines a common inlet chamber or section 125 (FIGS. 3 and 7) which communicates with the inlets of the pumping chambers 95, **95*a* and 95*b* by way of the filters 119, 119*a*, and 119*b*, respectively. More particularly, the inlet section 125 is defined by a peripheral wall 127 (FIGS. 3 and 7) of the housing section 23, an interior wall 129 and an end wall 131. The inlet section 125 communicates with the inlet 15 through an opening (not shown) in the peripheral wall 127**.

Figure 7:
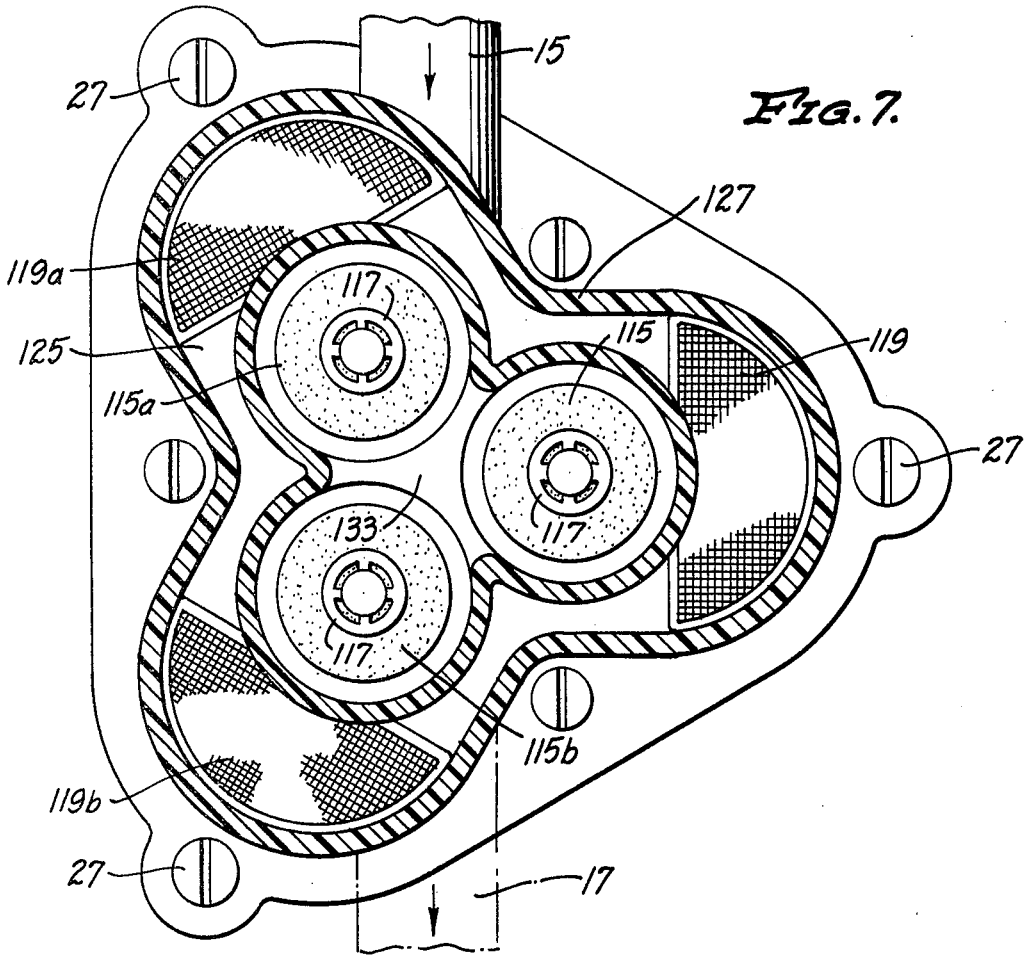
FIG. 7 is a sectional view taken generally along line 7—7 of FIG. 3.

The housing section 23 also defines a common outlet chamber section 133 (FIGS. 3 and 7). The outlet section 133 lies within the interior wall 129, and it communicates with the outlet check valves 115, **115*a* and 115*b* of the three pumping chambers. The outlet section 133 communicates with the outlet 117 by means of an opening (not shown) in the peripheral wall 127. The lower end (as viewed in FIG. 3) is sealed from the inserts 103, 103*a*, and 103*b* by a seal 134**.

A spring biased outlet valve 135 prevents discharge of fluid from the outlet section 133 until the discharge pressure has reached a predetermined minimum level. As pressure in a chamber 139 increases, a resilient diaphragm 141 is urged upwardly against the biasing action of a spring 143. A switch actuator 145 is carried upwardly with the diaphragm to actuate a microswitch 147 to de-energize the motor 19. As the pressure drops within the chamber 139, the spring 143 moves the actuator 145 downwardly, and the microswitch 147 is again actuated to energize the motor 19.

In operation of the pump 11, the motor 19 drives the wobble plate 45 as described above. The wobble plate 45 in turn drives the regions of the diaphragm 29 which are affixed to it. This provides an axial reciprocating pumping action in each of the pumping chambers 95, **95*a*, and 95*b*. At any instant, each of the pumping chambers 95, 95*a*, and 95*b*** is in a different part of its stroke inasmuch as the centers of these chambers are spaced apart 120°.

On the intake stroke of the pumping chamber 95, the associated region of the diaphragm 29 is moved downwardly as viewed in FIG. 3 to create a relatively low pressure within the pumping chamber 95. Accordingly, fluid in the inlet section 125 is drawn through the check valve 113 into the chamber 95. During this time, the outlet check valve 115 is maintained in a closed position by the relatively higher pressure in the outlet section 133. On the discharge stroke, the region of the diaphragm 29 forming one side of the pumping chamber 95 is advanced inwardly, i.e. upwardly as viewed in FIG. 3, to reduce the volume of the pumping chamber. This creates a relatively high pressure in the pumping chamber which maintains the inlet check valve tightly closed and which opens the outlet check valve 115 to permit flow of fluid into the outlet section 133. The action in the pumping chambers 95*a* and 95*b* is identical, but out-of-phase with the pumping action in the chamber 95 so that a substantially continuous discharge flow is provided.

The pump 11 is particularly adapted for pumping water, but it can be used to pump other liquids as well as gases. The diaphragm 29 completely isolates the pumping compartment 31 from the equipment compartment 33. Accordingly, no water contacts any of the parts in the equipment chamber 33 and no lubricant from the equipment chamber 33 can migrate into the pumping chambers 95, 95*a*, and 95*b*.

Although an exemplary embodiment of this invention has been shown and described, many changes, modifications and substitutions may be made by one having ordinary skill in the art without necessarily department from the spirit and scope of this invention.

I claim:

1. A pump adapted to be driven by a motor having a rotatable shaft comprising:

a housing having a cavity therein;

a flexible diaphragm extending across said cavity to divide the cavity into a pumping compartment on one side of the diaphragm and an equipment compartment on the other side of the diaphragm;

retaining means for retaining said diaphragm in said housing;

first means cooperable with a first region of said diaphragm to define a first pumping chamber;

said pumping chamber being in said pumping compartment;

means defining an inlet for said first pumping chamber;

means defining an outlet for said first pumping chamber;

a bearing support mounted on the housing in the equipment compartment;

a wobble plate;

bearing means axially intermediate said bearing support and said wobble plate for permitting said wobble plate to wobble and for transmitting radial loads from said wobble plate to the bearing support;

rotatable drive means in the equipment compartment for driving said wobble plate;

coupling means for drivingly coupling the drive means to the shaft of the motor whereby the wobble plate can be driven without substantially radially loading the motor shaft;

means for attaching the wobble plate to the diaphragm to substantially prevent rotation of the wobble plate, said first region of the diaphragm being movable by the wobble plate to provide a pumping action; and said coupling means including a bushing adapted to drivingly receive the shaft of the motor and resilient means for drivingly coupling the bushing and the drive means so that the shaft can rotate the drive means.

2. A pump adapted to be driven by a motor having a rotatable shaft comprising:

a housing having a cavity therein;

a flexible diaphragm extending across said cavity to divide the cavity into a pumping compartment on one side of the diaphragm and an equipment compartment on the other side of the diaphragm;

retaining means for retaining said diaphragm in said housing;

first means cooperable with a first region of said diaphragm to define a first pumping chamber;

said pumping chamber being in said pumping compartment;

means defining an inlet for said first pumping chamber;

means defining an outlet for said first pumping chamber;

a wobble plate in said equipment compartment;

means including a ball for mounting said wobble plate for wobbling movement about said ball with radial loads from said wobble plate being transmitted to said ball;

means for drivingly coupling the wobble plate to the shaft of the motor to substantially prevent the wobble plate from transmitting radial loads to the shaft of the motor;

means for attaching the wobble plate to the diaphragm to substantially prevent rotation of the wobble plate, said first region of the diaphragm being movable by the wobble plate to provide a pumping action in the first pumping chamber;

second means cooperable with a second region of said diaphragm to define a second pumping chamber in said pumping compartment, said second pumping chamber having an inlet and an outlet, said second region of the diaphragm being movable by the wobble plate to provide a pumping action in the second pumping chamber; and said first means including a first cup-shaped insert and said second means including a second cup-shaped insert, means in said housing defining a common inlet chamber communicating with the inlets of said first and second pumping chambers and means in said housing defining a common outlet chamber communicating with said outlets of said first and second pumping chambers.

3. A pump adapted to be driven by a motor having a rotatable shaft comprising:

a housing having a cavity therein;

a flexible diaphragm extending across said cavity to divide the cavity into a pumping compartment on one side of the diaphragm and an equipment compartment on the other side of the diaphragm;

retaining means for retaining said diaphragm in said housing;

first means cooperable with a first region of said diaphragm to define a first pumping chamber;

said pumping chamber being in said pumping compartment;

means defining an inlet for said first pumping chamber;

means defining an outlet for said first pumping chamber;

a wobble plate in said equipment compartment;

means for mounting said wobble plate for movement in said equipment compartment;

means for drivingly coupling the wobble plate to the shaft of the motor so that the motor can drive the wobble plate;

means for attaching the wobble plate to the diaphragm to substantially prevent rotation of the wobble plate, said first region of the diaphragm being movable by the wobble plate to provide a pumping action in the first pumping chamber;

second means cooperable with a second region of said diaphragm to define a second pumping chamber in said pumping compartment, said second pumping chamber having an inlet and an outlet, said second region of the diaphragm being movable by the wobble plate to provide a pumping action in the second pumping chamber; and said first means including a first cup-shaped insert and said second means including a second cup-shaped insert, means in said housing defining a common inlet chamber communicating with the inlets of said first and second pumping chambers and means is said housing defining a common outlet chamber communicating with said outlets of said first and second pumping chambers.

4. A pump adapted to be driven by a motor having a rotatable shaft comprising:

a housing having a cavity therein;

a flexible diaphragm extending across said cavity to divide the cavity into a pumping compartment on one side of the diaphragm and an equipment compartment on the other side of the diaphragm;

retaining means for retaining said diaphragm in said housing;

first means cooperable with a first region of said diaphragm to define a first pumping chamber;

second means cooperable with a second region of said diaphragm to define a second pumping chamber;

said pumping chambers being in said pumping compartment;

means defining an inlet for said first pumping chamber and an inlet for said second pumping chamber;

means defining an outlet for said first pumping chamber and an outlet for said second pumping chamber;

a wobble plate in said equipment compartment;

means including a ball for mounting said wobble plate for wobbling movement about said ball with radial loads from said wobble plate being transmitted to said ball;

means for drivingly coupling the wobble plate to the shaft of the motor to substantially prevent the wobble plate from transmitting radial loads to the shaft of the motor;

means for attaching the wobble plate to the first and second regions of the diaphragm, said first and second regions of the diaphragm being movable by the wobble plate to provide a pumping action in the first and second pumping chambers, respectively;

said means for attaching including first and second clamps on opposite sides of the first region of the diaphragm for clamping the first region of the diaphragm and means for coupling said clamps to the wobble said wobble plate being movable along a path having components which extend in first and second generally transverse directions, said first and second regions of said diaphragm and said clamps being movable in said first direction to provide said pumping action, each of said first and second regions of said diaphragm including a folded section for accommodating movement of said wobble plate in said second direction; and said folded section of said first region circumscribing the clamps intermediate the clamps and the periphery of the first pumping chamber.

5. A pump adapted to be driven by a motor having a rotatable shaft comprising:

a housing having a cavity therein;

a flexible diaphragm extending across said cavity to divide the cavity into a pumping compartment on one side of the diaphragm and an equipment compartment on the other side of the diaphragm;

retaining means for retaining said diaphragm in said housing;

first means cooperable with a first region of said diaphragm to define a first pumping chamber;

said pumping chamber being in said pumping compartment;

means defining an inlet for said first pumping chamber;

means defining an outlet for said first pumping chamber;

a wobble plate in said equipment compartment;

means including a ball for mounting said wobble plate for wobbling movement about said ball with radial loads from said wobble plate being transmitted to said ball;

first means for drivingly coupling the wobble plate to the shaft of the motor to substantially prevent the wobble plate from transmitting radial loads to the shaft of the motor;

said first means including a cam, means for mounting said cam for rotation within said housing, and antifriction bearing means located between said cam and said wobble plate for transmitting substantially only axial loads whereby rotation of said cam causes said wobble plate to wobble;

said antifriction bearings including at least one rotatable element located radially outwardly of said ball, said rotatable element having an axis of rotation which extends substantially through the center of said ball; and means for attaching the wobble plate to the diaphragm to substantially prevent rotation of the wobble plate, said first region of the diaphragm being movable by the wobble plate to provide a pumping action in the first pumping chamber.

6. A pump as defined in claim 5 wherein said bearing means includes a second rotatable element having an axis of rotation which extends substantially through the center of said ball.

7. A pump as defined in claim 5 wherein said wobble plate is movable along a path having components which extend in first and second generally transverse directions, said first region of said diaphragm being movable in said first direction to provide said pumping action, said first region of said diaphragm including a folded section for accommodating movement of said wobble plate in said second direction.

8. A pump adapted to be driven by a motor having a rotatable shaft comprising:

a housing having a cavity therein;

a flexible diaphragm extending across said cavity to divide the cavity into a pumping compartment on one side of the diaphragm and an equipment compartment on the other side of the diaphragm;

retaining means for retaining said diaphragm in said housing;

first means cooperable with a first region of said diaphragm to define a first pumping chamber in said pumping compartment, said first pumping chamber having an inlet and an outlet;

second means cooperable with a second region of said diaphragm to define a second pumping chamber in said pumping compartment, said second pumping chamber having an inlet and an outlet;

means in said housing defining a common inlet chamber communicating with the inlets of said first and second pumping chambers;

means in said housing defining a common outlet chamber communicating with the outlets of said first and second pumping chambers;

a wobble plate in said equipment compartment;

means for mounting said wobble plate for movement in said equipment compartment;

means for drivingly coupling the wobble plate to the shaft of the motor so that the motor can drive the wobble plate;

means for attaching the wobble plate to the diaphragm to substantially prevent rotation of the wobble plate, said first and second regions of the diaphragm being movable by the wobble plate to provide a pumping action in the first and second pumping chambers, respectively;

said first means including an insert in the pumping compartment of said housing, said insert defining a cavity having an open end across which the diaphragm extends; and said inlet and said outlet of said first pumping chamber being provided on said insert.

9. A pump as defined in claim 8 including inlet check valve means carried by said insert for permitting flow from said common inlet chamber into said first pumping chamber and for substantially preventing flow from said first pumping chamber to said common inlet chamber.

10. A pump as defined in claim 8 including outlet check valve means carried by said insert for permitting flow from said first pumping chamber to said common outlet chamber and for substantially preventing flow in the reverse direction from the common outlet chamber to said first pumping chamber.

11. A pump as defined in claim 8 including a filter carried by said insert adjacent the inlet of the first pumping chamber.

12. A pump as defined in claim 8 wherein said housing includes first and second housing sections and means for holding said housing sections together, at least one of said housing sections being constructed of molded plastic material and having means for receiving said insert, said insert being constructed of plastic material.

13. A pump as defined in claim 8 wherein said wobble plate is movable along a path having components which extend in first and second generally transverse directions, said first region of said diaphragm is movable in said first direction to provide said pumping action in said first pumping chamber, and said first region of the diaphragm includes excess material for accommodating movement of said wobble plate in said second direction.

14. A pump as defined in claim 8 wherein said housing includes first and second housing sections, said housing sections having confronting clamping sections, said retaining means including said confronting clamping sections of said housing, a peripheral region of said diaphragm being clamped between said clamping sections, at least said peripheral region being resilient and forming a seal between said housing sections, the periphery of said insert lying radially inwardly of said peripheral region of said diaphragm which is clamped between said clamping sections of said housing sections.

15. A pump as defined in claim 14 including inlet check valve means carried by said insert for permitting flow from said common inlet chamber into said first pumping chamber and for substantially preventing flow from said first pumping chamber to said common inlet chamber, said housing includes first and second housing sections and means for holding said housing sections together, at least one of said housing sections being constructed of molded plastic material and having means for receiving said insert, said insert being constructed of plastic material.

16. A pump adapted to be driven by a motor having a rotatable shaft comprising:

a housing having a cavity therein;

a flexible diaphragm extending across said cavity to divide the cavity into a pumping compartment on one side of the diaphragm and an equipment compartment on the other side of the diaphragm;

retaining means for retaining said diaphragm in said housing;

first means cooperable with a first region of said diaphragm to define a first pumping chamber;

said pumping chamber being in said pumping compartment;

means defining an inlet for said first pumping chamber;

means defining an outlet for said first pumping chamber;

a wobble plate in said equipment compartment;

means for mounting said wobble plate for wobbling movement in said equipment compartment;

means for drivingly coupling the wobble plate to the shaft of the motor;

means for attaching the wobble plate to the first region of the diaphragm, said first region of the diaphragm being movable by the wobble plate to provide a pumping action in the first pumping chamber;

said means for attaching including first and second clamps on opposite sides of the first region of the diaphragm for clamping the first region of the diaphragm and means for coupling said clamps to the wobble plate;

said wobble plate being movable along a path having components which extend in first and second generally transverse directions, said first region of said diaphragm and said clamps being movable in said first direction to provide said pumping action, said first region of said diaphragm including a folded section for accommodating movement of said wobble plate in said second direction; and said folded section circumscribing the clamps intermediate the clamps and the periphery of the first pumping chamber.

17. A pump as defined in claim 16 wherein said folded section defines a cavity which opens inwardly into the first pumping chamber.

* * * * *